United States Patent [19]

Swanson

[11] 4,018,015

[45] Apr. 19, 1977

[54] TRAILER ANCHORING DEVICE

[76] Inventor: Gladys B. Swanson, P. O. Box 403, Shevlin, Minn. 56676

[22] Filed: Oct. 20, 1975

[21] Appl. No.: 623,774

[52] U.S. Cl. ..... 52/23; 52/DIG. 11

[51] Int. Cl.[2] ..... E04D 1/34; E02D 5/80

[58] Field of Search ..... 52/23, DIG. 11, 3, 4, 52/5, 83; 24/115 K, 122 G, 265 CD, 265 AL; 248/449, 505; 105/466, 469, 470, 472, 471, 477, 468

[56] References Cited

UNITED STATES PATENTS

| | | | |
|---|---|---|---|
| 2,372,967 | 4/1945 | Martin | 105/469 |
| 2,447,921 | 8/1948 | Thomas | 24/265 |
| 3,054,151 | 9/1962 | Shankland | 52/23 |
| 3,668,740 | 6/1972 | Pearson | 105/469 |
| 3,691,703 | 9/1972 | Barnes | 52/23 |
| 3,744,192 | 7/1973 | Burnett | 52/23 |
| 3,757,475 | 9/1973 | Hackworth | 52/23 |
| 3,830,457 | 8/1974 | Stewart | 52/23 |
| 3,887,966 | 6/1975 | Gley | 24/68 CD |
| 3,914,910 | 10/1975 | Struben | 52/DIG. 11 |

*Primary Examiner*—Price C. Faw, Jr.
*Assistant Examiner*—Henry Raduazo

[57] ABSTRACT

A device is provided for anchoring a trailer or mobile home. This comprises a belt formed of a plurality of woven nylon ropes preferably interlaced with wire and anchored at its ends to transverse metal bars. The belt extends over the trailer and down along the sides thereof. The bars are anchored by cables to anchor blocks imbedded in the ground.

1 Claim, 3 Drawing Figures

TRAILER ANCHORING DEVICE

This invention relates to an improvement in a means for anchoring a trailer to the ground.

BACKGROUND OF THE INVENTION

The various storms and tornados have wrecked havock upon a lot of the trailers or mobile homes. In view of the fact that these trailers or homes normally rest upon concrete blocks or the like, they are much more susceptible to destruction than homes which are built on solid foundations. Numerous accidents have occurred during wind storms, cyclones, tornados and the like which are capable of destroying trailer homes but do little damage to permanent fixtures such as buildings, houses and the like. As a result, the present structure is designed to disclose a means of anchoring the trailer to its base, so that it will not be overturned in the event of winds of high velocity.

SUMMARY OF THE INVENTION

The present invention resides in the provision of a means of tying down a house trailer or mobile home so that it will not be affected by high winds. As a result, the mobile homes which are merely resting upon a suitable base by gravity, cannot be readily overturned due to the pressure of high winds or the like.

A further feature of the present invention resides in the provisions of anchor blocks which are preferably embedded in the ground on either side of the trailer or mobile home, and which are connected by a band of material which is strong enough to prevent the overturning of the trailer even when it is subjected to high winds.

A further feature of the present invention lies in the fact that the band is formed of a series of strands of a woven nylon rope or the like which is preferably interlaced with fine wire. As a result, the rope or belt is exceedingly strong, and is capable of retaining the trailer in an upright position even when the trailer is subjected to extremely high wind pressure.

An added feature of the present invention lies in the fact that the ends of the belt which extends over the trailer and down the sides thereof are connected to an anchoring bar, which in turn, is connected to anchoring block by means of wire cables so that there is little or not danger of overturning the trailer regardless of the wind pressure.

It should be understood that trailers, in trailer camps, have been subjected to frequent irreparable damage due to high winds pressure. Trailers are usually supported upon wheels or more permanently upon concrete blocks. A skirt usually surrounds the area between the trailer and the ground. Due to the fact that trailers are long relative to their width and depth, they present a great area subject to wind pressure. In view of the fact that they are not actually supported to the blocks or other such means, high winds provide a real hazard to vehicles of this type. If the wind topples a trailer home from its support, it falls through more than a ninety degree angle and causes extreme damage to the trailer as well as the contents. If the applicant's portion of the country there are many such incidents in which trailer homes have been destroyed, damage incurred and even death to any of the occupants of the trailer.

These and other objects and novel features of the present invention will be more clearly and fully set forth in the following specification and claims.

DESCRIPTION OF THE PREFERRED EMBODIMENTS

Figure 1:
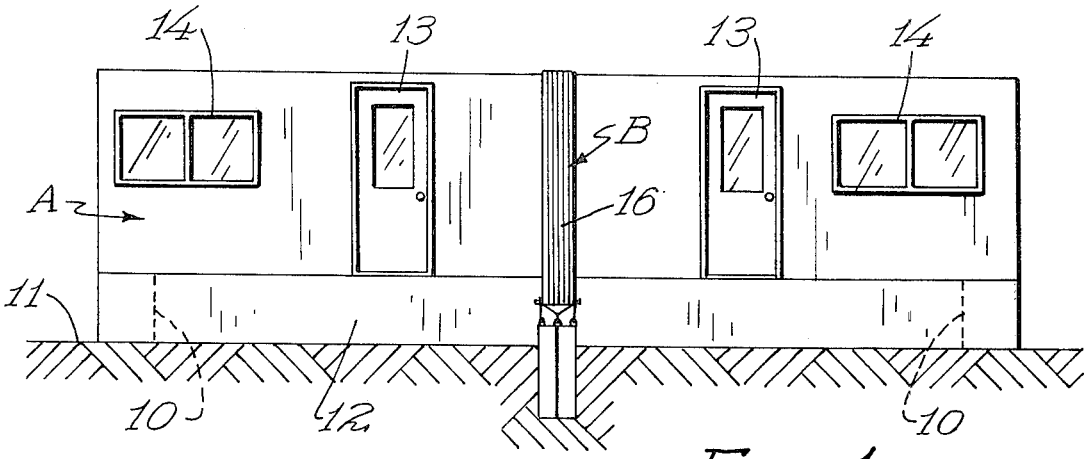
FIG. 1 is a side elevation view of a trailer or mobile home, a section being shown through the ground near the trailer.
Figure 2:
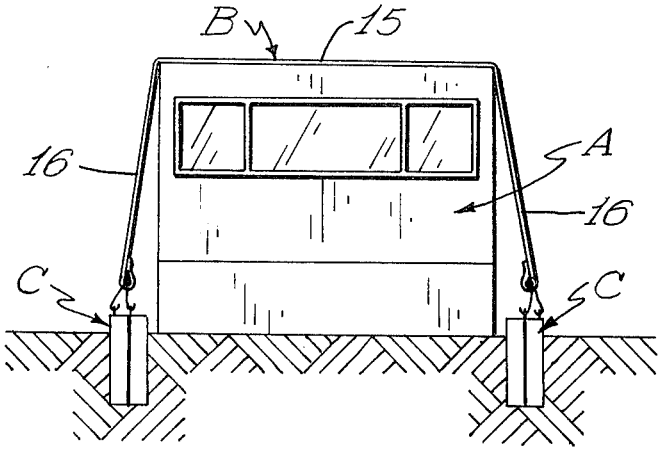
FIG. 2 is an elevational view of the trailer and anchoring device.
Figure 3:
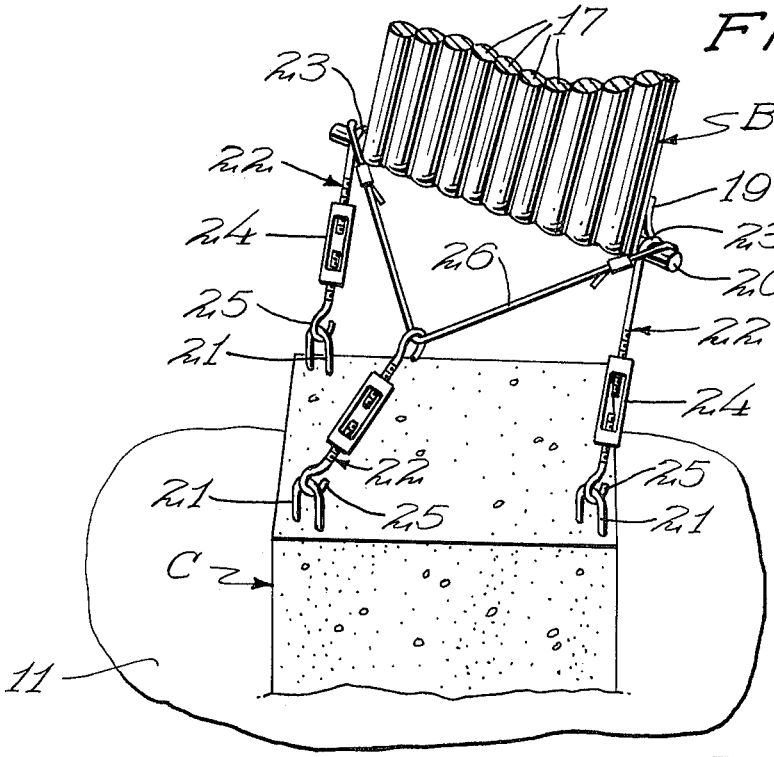
FIG. 3 is a perspective view of the anchoring block to which the belt is connected.

The trailer or mobile home is indicated in general by the numeral A. Under normal conditions the trailer is supported upon suitable blocks such as 10 so as to hold the floor of the trailer in spaced relation to the ground level 11. A skirt 12 is normally provided to close off the area beneath the trailer A. Obviously, the trailer A may be of any suitable size or shape and is provided with one or more doors 13 and windows 14. In other words, the trailer or mobile home A is merely diagrammatically illustrated.

The anchoring device indicated in general by the letter B. This comprises an elongated belt having a center portion 15 which overlies the top of the trailer and downwardly extending end portions 16 which extend downwardly from the top portion 15. In the particular arrangement illustrated, the belt B is formed of a series of side by side woven nylon ropes 17, the ends of which are folded as indicated at 19 to accommodate a metal bar 20 which extends somewhat beyond the sides of the belt .Anchoring blocks such as are embedded in the ground on either side of the house trailer i, and are spaced apart a distance sufficient so that the trailer i may be drawn between them in the event the trailer is moved.These anchoring blocks include three loops such as 21 which are embedded in the concrete body of the anchoring members and project upwardly therefrom at three corners of the block.Connecting members such as 22 include looped ends 23 which extend about the ends of the metal rod 20. The connecting means 22 include turnbuckles 24 by means of which the rods 20 may be secured to the anchoring blocks C.These connecting means include lower hook ends 25 which hook through the two opposed loops 21. A bridle 6 is also looped over the rod 20 and is connected by the similar connecting means 22 to the third loop 21 which is most remote from the belt. In this way, all of the connecting means 22 may be similar in form.

The anchoring device is very effective in holding the trailer upon its supporting blocks. As a result, the chance of the trailer being tipped over by the wind is very remote. In the event the trailer is of extreme length, two such belts B may be employed in spaced relation throughout the length of the trailer. However, in actual practice, a single belt has proven to do the job effectively.

In accordance with the Patent Statutes, I have described the principles of construction and operation of my Trailer Anchoring Device, and while I have endeavored to set forth the best embodiments, I desire to have it understood that obvious changes may be made within the scope of the following claims without departing from the spirit of my invention.

I claim:

1. A trailer anchoring device including a belt extending over the top of the trailer and down the sides thereof, an anchoring block on each side of the trailer, a transversely extending bar at each end of the belt, said bars extending longitudinally of said trailer and extending transversely beyond said belt, three anchoring rings extending upwardly from anchoring block, a pair of means connecting said bars to the anchoring ring most remote from the end of said belt, an independent means securing the ends of said bars to the remaining anchoring means.

* * * * *